US005082544A

United States Patent [19]

Willey et al.

[11] Patent Number: 5,082,544

[45] Date of Patent: Jan. 21, 1992

[54] APPARATUS FOR GAS GENERATION

[75] Inventors: Alan P. Willey; Neal T. Radford, both of Metro Manila, Philippines

[73] Assignee: Command International, Inc., Hong Kong

[21] Appl. No.: 473,668

[22] Filed: Feb. 2, 1990

[30] Foreign Application Priority Data

Nov. 17, 1989 [GB] United Kingdom ..... 8926096

[51] Int. Cl.[5] ..... C25B 9/00; C25B 11/02; C25B 15/08

[52] U.S. Cl. ..... 204/270; 204/272; 204/278; 204/279

[58] Field of Search ..... 204/256, 258, 262, 266, 204/270, 272, 278, 277, 279, 269

[56] References Cited

U.S. PATENT DOCUMENTS

| | | | |
|---|---|---|---|
| 820,113 | 5/1906 | Hinkson | 204/269 X |
| 3,507,770 | 4/1970 | Fleming | 204/272 |
| 3,990,962 | 11/1976 | Götz | 204/272 X |
| 4,206,029 | 6/1980 | Spirig | 204/274 X |
| 4,317,709 | 3/1982 | Ichisaka et al. | 204/274 X |
| 4,336,122 | 6/1982 | Spirig | 204/274 X |
| 4,344,831 | 8/1982 | Weber | 204/274 X |
| 4,361,474 | 11/1982 | Shoaf et al. | 204/274 X |

*Primary Examiner*—Donald R. Valentine
*Attorney, Agent, or Firm*—Townsend and Townsend

[57] ABSTRACT

An electrolytic gas generating apparatus for producing a combustible mixture of hydrogen and oxygen by electrolysis of water is disclosed, for particular use in a gas welding apparatus. The generating apparatus comprises a d.c. power supply 100 connected to electrolytic cells 200, a dehumidifier 400 for scrubbing the gas mixture generated by the cells 200, a gas regulator 500, a modifier 600 which modifies the combustion characteristics of the gas and a flash arrester 660. Gas generation is controlled by a main control board 800 in accordance with sensors which measure parameters to calculate indirectly the gas flowrate and control this in accordance with demand.

6 Claims, 9 Drawing Sheets

N.B. K1 to K4 = constants

Icmax = MAX CELL CURRENT
Icmin = MIN CELL CURRENT

APPARATUS FOR GAS GENERATION

FIELD OF THE INVENTION

This invention relates to apparatus for gas generation particularly but not exclusively for use in welding apparatus.

BACKGROUND OF THE INVENTION

Devices which generate hydrogen and oxygen gases by electrolysis of water for use as a combustible mixture in gas welding apparatus have been proposed. Such devices, in general concept, have the advantage over conventional gas welding equipment that storage of dangerous bottled gases such as acetelyene or LPG is not required. The formation of a combustible mixture by electrolysis of water is also potentially inexpensive and the product of combustion of the gas mixture, being water, is not harmful.

However, previous attempts at designs of such devices have not proved to be commercially successful due to high manufacturing cost and poor gas producing efficiency.

It is an object of the invention to provide an improved gas generating apparatus.

SUMMARY OF THE INVENTION

According to the invention in a first aspect, there is provided an end cap for an electrolytic gas generation cell including a plurality of nested electrode tubes, the end cap having means for locating the tubes in spaced relation and a plurality of openings interconnecting the regions between the tubes.

In a first preferred form, the openings between adjacent pairs of regions are offset relative to one another and preferably are opposed to one another.

An end cap of this construction find particular application as a bottom end cap of a vertically arranged electrolytic cell, the end cap providing inter-connection paths for the electrolyte disposed between the tubes while minimising the by-pass current across the tubes.

In a second preferred form, the locating means comprises a plurality of lands, the openings being formed between the lands. An end cap of this construction find particular application as a top end cap of a vertically arranged cell. The openings allowed convenient exit parts for the gas from the cell. The lands serve to space the tubes from the openings so that, when filled with gas, a substantial by-pass current across the top of the cells is prevented.

The locating means preferably locates the nested tubes concentrically.

According to the invention in a second aspect, there is provided gas generation apparatus comprising an electrolytic cell and a demister for demisting gas generated by the cell, the cell and demister using the same working liquid and the cell being connected to the demister whereby liquid from the demister is able to be supplied to the cell.

Preferably the working liquid supplied to the demister is dionized water and the cell uses a metal hydroxide dissolved in water as an electrolyte. Dehumidification of the gas results in entrained hydroxide being dissolved by the deionized water, this weak hydroxide solution then being supplied to the cell on demand.

According to the invention in a third aspect there is provided gas generation apparatus comprising means for generating a first combustible gas and means for mixing a second combustible gas with the first combustible gas and further comprising bypass means for bypassing the combining means and regulating means for controlling the by-pass means.

Preferably the first combustible gas is arranged to be bubbled through a volatile combustible liquid, the second gas thus becoming entrained with the first gas. Preferably the first gas is a hydrogen/oxygen mixture and the second gas is a volatized hydrocarbon.

According to the invention in a fourth aspect, there is provided apparatus for modifying the combustion characteristics of a gas, the apparatus comprising a vessel for a combustible fluid in liquid form and means for bubbling a combustible gas through the liquid, said means comprising a diffuser.

Preferably the diffuser comprises a manifold having a plurality of spaced gas outlets.

The manifold may be in the form of an inverted tray, the gas outlets being spaced around the periphery of the tray.

According to the invention in a fifth aspect, there is provided a method of measuring the gas flowrate from an electrolytic cell of an electrolytic gas generator comprising the steps of measuring the current (IC) supplied to the cell, the cell temperature (TM) and cell pressure (PM) and calculating the flowrate in accordance with the following equation:

$$\text{Flowrate} = K1.IC - K_2(\Delta PM/(\Delta TM.t_S))$$

Where $\Delta TM$ is the change in cell temperature $\Delta PM$ is the change in cell pressure K1, K2 are constants $t_S$ = sampling rate If the generator comprises a further vessel in which gas may become stored, the flowrate may be calculated in accordance with the following equation:

$$\text{Modified flowrate} = K\text{-}1 \times IC - K_2(\Delta PM/(\Delta TM.t_S) - K_3(\Delta PR/(\Delta TR.t_S)\text{-}).$$

Where $\Delta TR$ is the change in temperature in the further vessel $\Delta PR$ is the change in pressure in the further vessel $K_1$, $K_2$, $K_3$: Constants The invention further provides a method of controlling the gas generated by controlling the input current to give a required flowrate, the flowrate being calculated in accordance with the fifth aspect of the invention.

Furthermore, the invention provides apparatus for calculating the gas flowrate in an electrolytic gas generator having at least one cell, the apparatus comprising means for measuring the input current to the cell, means for measuring the cell temperature, means for measuring the cell pressure and processing means for calculating the flowrate in accordance with the fifth aspect of the invention.

According to the invention in a sixth aspect there is provided an electrolytic gas generator comprising a gas generation cell having a plurality of electrodes for receiving a working liquid therebetween, gas conditioning means connected to the cell for removing working liquid vapour entrained in gas generated by the cell; and means for matching the working liquid removing capacity of the gas conditioning means to the operation of the cell, the matching means comprising temperature control means for controlling the temperature of the working liquid in the cell.

Preferably the temperature is controlled to be less than 75° C., in the range 55° C.-75° C. and substantially 65° C.

According to the invention in a seventh aspect, there is provided an electrolytic cell comprising a container for electrolyte, an electrode assembly disposed in the container, the electrode assembly comprising a plurality of electrodes disposed in the container and an electrical connector outside the container; and a support member for supporting the electrodes and the support member abutting directly against the container, forming a seal therewith.

Preferably the support member comprises an end-cap for locating the electrodes relative to one another and is of the form as recited in the first aspect of the invention.

According to the invention in an eight aspect of the invention there is provided an electrolytic cell comprising first sensing means for sensing a first condition of the cell and first control means for reducing directly the cause of said condition, second sensing means for sensing at least one second condition of the cell and second control means responsive to the second sensing means for cutting power to the cell and third sensing means for sensing a third condition of the cell and third control means for cutting the power to the cell after a predetermined delay and wherein the first, second and third control means are independent of each other.

Preferably, the first control means comprises a mechanically operated pressure release valve, the second control means trips a power supply relay and third control means deactuates a power supply control circuit.

BRIEF DESCRIPTION OF THE DRAWINGS

An embodiment of the invention will now be described, by way of example, with reference to the accompanying drawings in which.

DETAILED DESCRIPTION OF THE PREFERRED EMBODIMENT

With reference to the figures, an embodiment of gas generating apparatus according to the invention is shown, applied to a gas welding system. In general terms, the device produces a combustible mixture of hydrogen and oxygen by electrolysis of water, which is processed to provide a suitable gas mixture for use with a gas welding torch.

Figure 1:
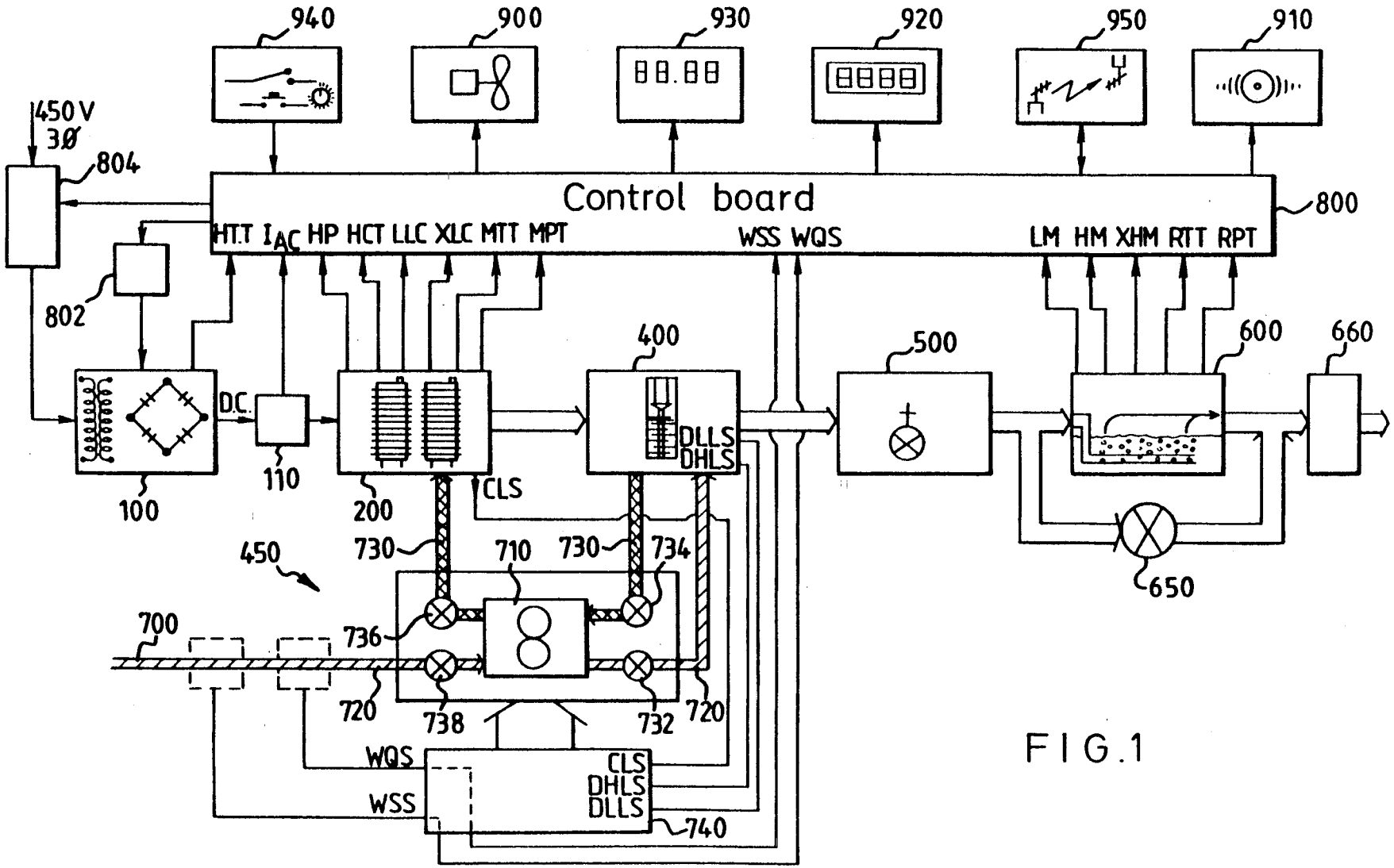
FIG. 1 is a schematic diagram of the gas generating apparatus of the invention.

With reference to FIG. 1, a schematic diagram showing the main elements of the gas generating apparatus is shown. The principal operational elements comprise a current controllable d.c. power supply 100 which includes transformers/rectifiers for converting a three phase alternating power supply to a controllable d.c. supply suitable for electrolysing water (preferably in the range 15-120 V D.C.). The d.c. output from the power supply 100 is fed via a shunt 110, which is used as a current measuring sensor, to a plurality of electrolytic cells 200. Gas output from the cells 200 is fed to a demister 400 which scrubs the gas, a gas flow regulator 500, a modifier 600, which modifies the combustion characteristics of the gas, the degree of use of which is controlled by a by-pass valve 650, and a flash arrester 660. The resulting gas mixture is fed from the flash arrestor to a gas welding torch (not shown).

The electrolytic cells 200 and demister 400 both use deionized water as a working liquid, the electrolyte for the cells being potassium hydroxide (KOH). The electrolytic cells 200 and dehumidifyer 400 are fed, on demand, with deionized water by pumping system 450.

Gas generation, temperature control, external display and fail safe alarm systems are controlled by main control board 800, which, for the control of gas generation, receives temperature and pressure measurements from the electrolytic cells 200 via main temperature and pressure sensors MTT and MPT, and from the modifier 600 via pressure and temperature sensors RTT and RPT and actual cell current, IAC, as measured by shunt 110.

Figure 12:
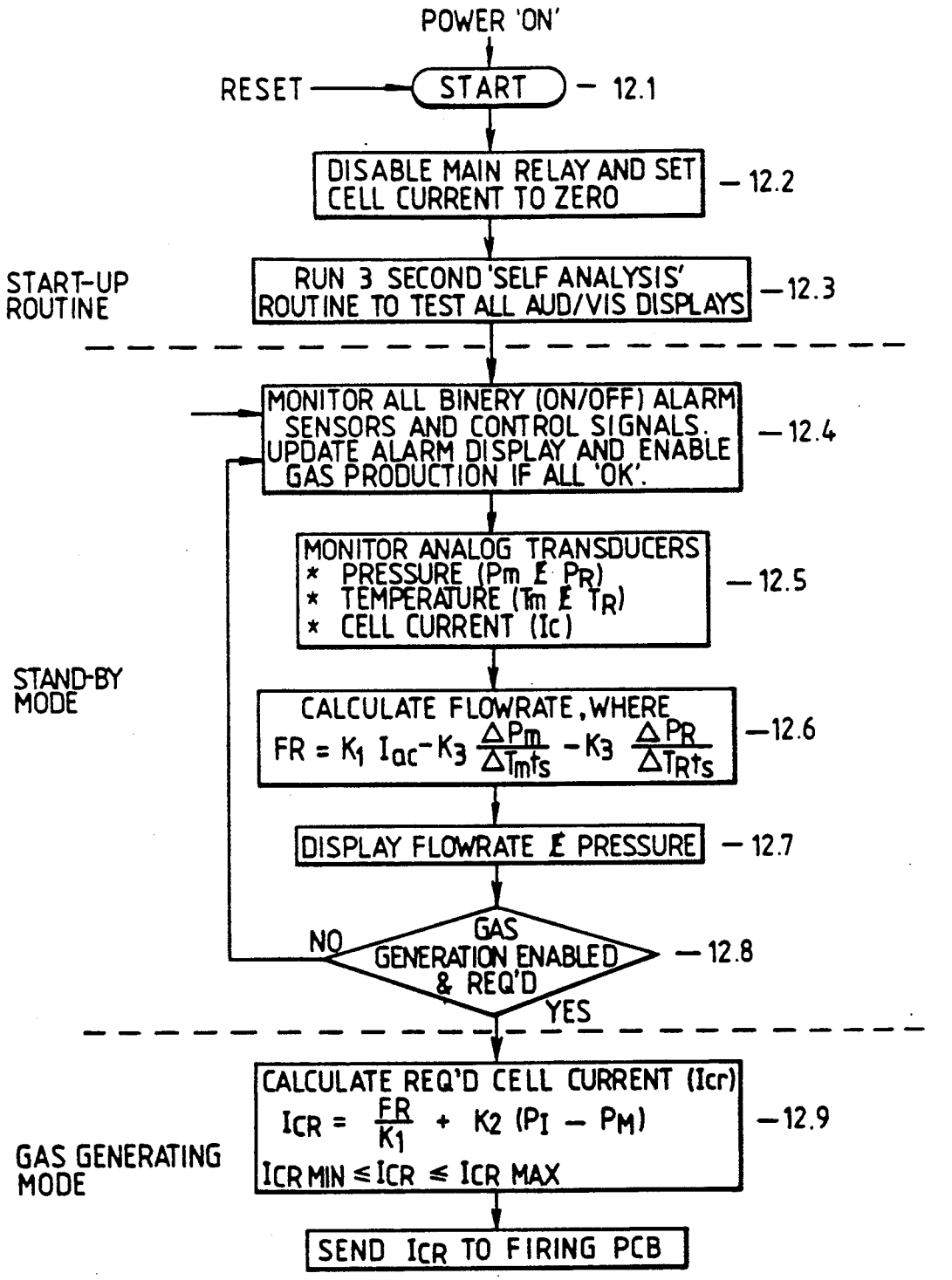
FIG. 12 is a flow diagram illustrating the gas flow control functions of the control board of FIG. 1.

Using this information and in accordance with the operational method shown in the flowchart of FIG. 12, the cell current is controlled by the control board 800, by regulating the current controllable DC power supply 100 by means for controller 802, which is preferably a firing board for thyristor based switches within the power supply 100.

In addition to controlling the flow of gas mixture, the control board 800 also acts to control the working liquid temperature of the electrolytic cells 200, by monitoring this temperature through the main temperature sensor MTT and actuating fans 900 if the temperature exceeds a preset limit, in the range 55°-75° C., preferably 65° C. This control is needed to prevent over-entrainment of KOH via the gas flow and is chosen so that the KOH entrainment level is matched to the demister's vapour removal capacity.

For the fail safe systems, the control board 800 monitors signals from other sensors, namely a hightransformer temperature sensor HTT connected to the transformer of power supply 100, an extra low cell level water XLC, a high cell temperature sensor HCT and a high pressure sensor HP, all connected to the cells 200 and a modifier low liquid level sensor LM, a high modifier level sensor HM and an extra high modifier Level sensor XHM all connected to modifer 400. The control board 800 and pumping system 450 also receives further signals from a water supply sensor WSS and a water quality sensor WQS.

These sensors are monitored to provide a multi-level safety system to deactuate the gas generating apparatus and at the same to actuate an alarm 910.

The control board 800 drives displays of gas flowrate 920 and gas pressure 930 and is responsive to on/off and reset controls 940. The control board 800 further, preferably, has a remote control/input/output facility 950.

Figure 2:
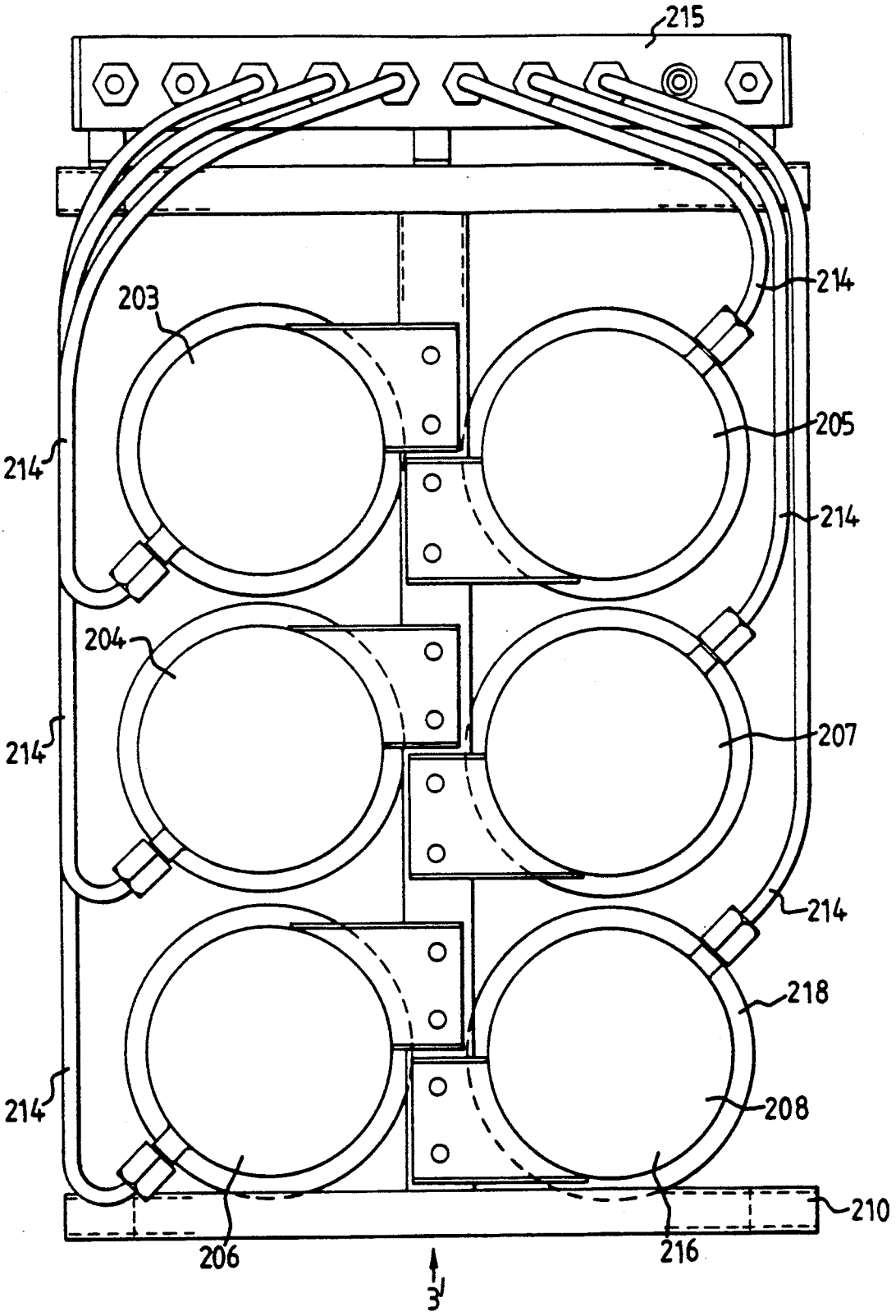
FIG. 2 is a plan view of the electrolytic cell unit of the appartus of FIG. 1.
Figure 3:
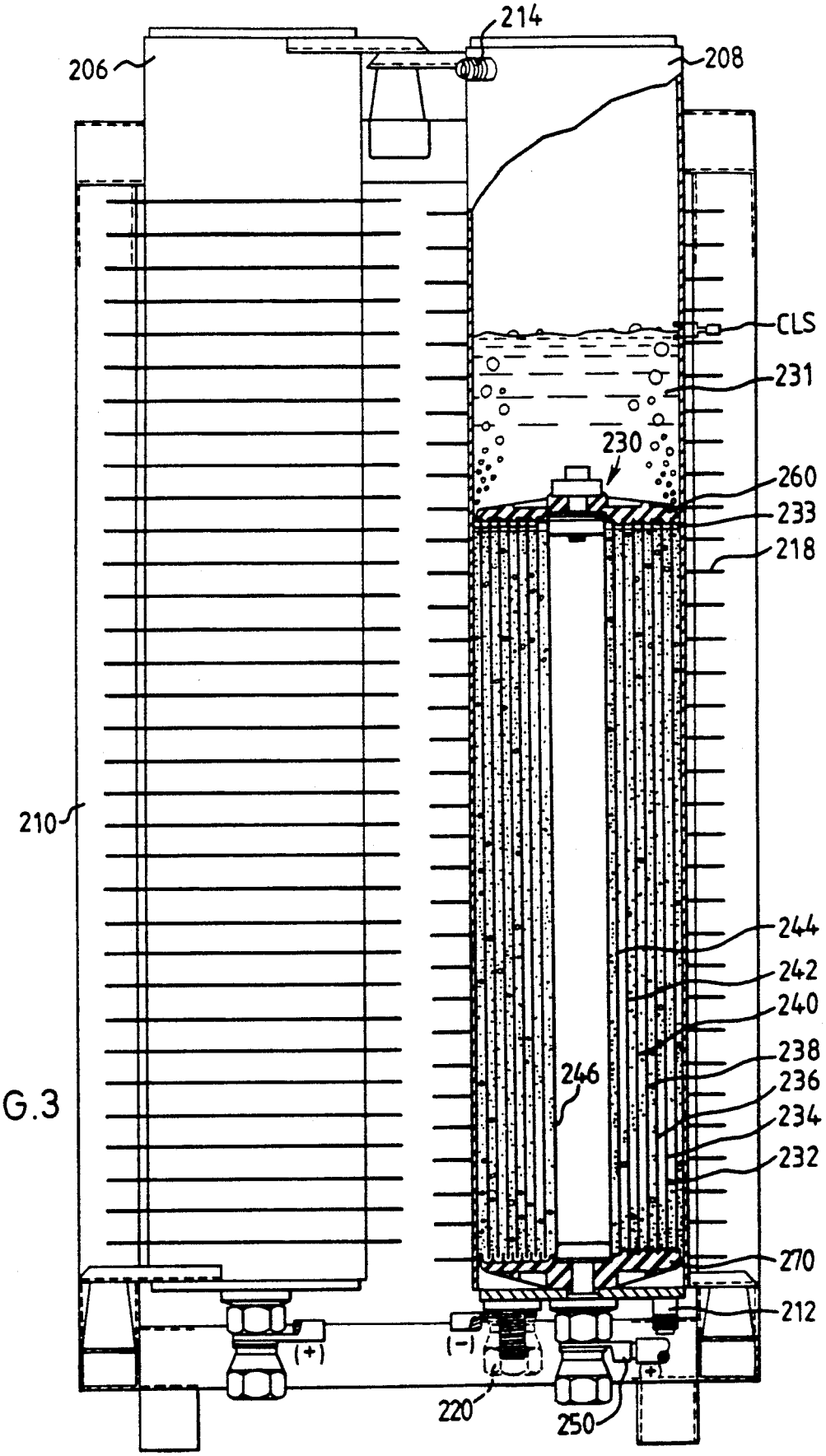
FIG. 3 is a side view of the unit of FIG. 2 in the direction of arrow 3', partly sectioned.

With reference to FIG. 2 and FIG. 3 the cell unit 200 is shown and comprises six electrolytic cells 203, 204, 205, 206, 207, 208. The six cells are rigidly mounted in a frame 210.

Each cell has a deionized water inlet 212 and gas outlet 214, all inlets 212 and outlets 214 being connected together via respective manifolds (outlet manifold 215 being shown in FIG. 2). Each cell comprises a housing 216 provided with cooling fins 218. The housing 216 forms a cathode of the electrolytic cell and is provided with an electrical connector 220 at the base thereof. An electrode assembly generally designated 230 is retained with the housing 216 and, in use, is submerged in electrolyte 331. The assembly 230 comprises a plurality of concentrically arranged cylindrical electrodes 232, 234, 236, 238, 240, 242, 244, 246. The central electrode 246 forms a central anode of the electrolytic cell and is connected to an electrical connector 250 provided at the base of the cell. The electrodes are formed from mild steel with a nickel electroplated coating being formed on the anode (outer) surface of each electrode. The electrodes are retained in their respective positions by means of end caps 260, 270 formed from an insulating material, preferably PTFE.

Figure 4:
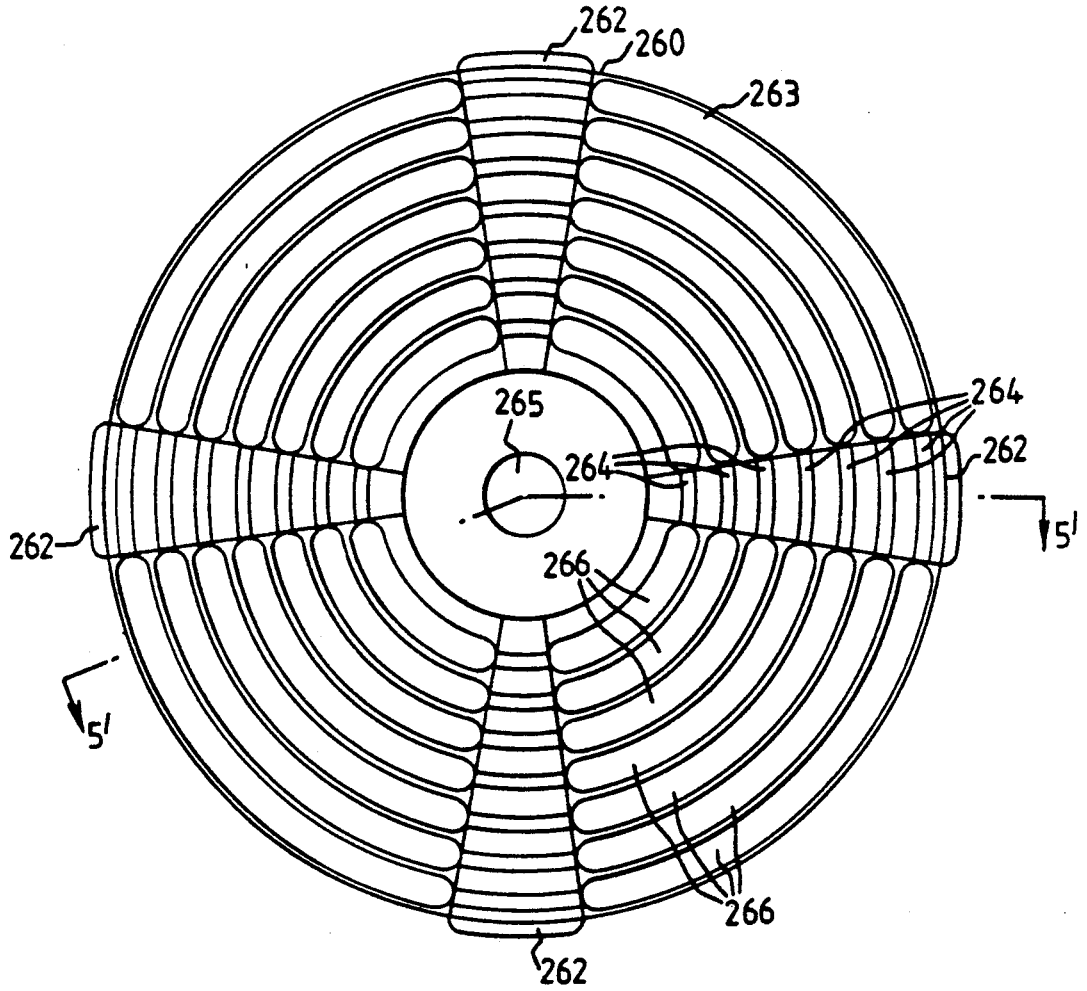
FIG. 4 is a plan view of a top end cap of the cell shown in FIG. 3.
Figure 5:
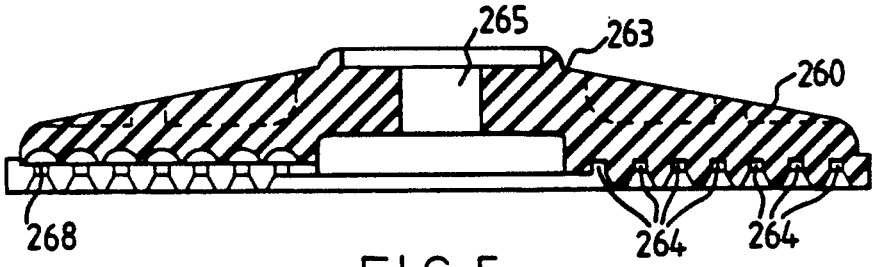
FIG. 5 is a view across section 5'—5' of FIG. 4.

The upper end cap is shown in FIGS. 4 and 5 and is designed to provide a low resistance to flow of gas out of the electrolytic cell while at the same time holding the electrodes in position and preventing any substantial leakage current occurring across the electrodes. The end cap 260 comprises a plurality of lands 262 connected to a base 263 having a central opening 265. A plurality of channels 266 are formed between the lands 262. Each land 262 is provided with a plurality of slots 264 each for receiving an arcuate portion of a respective tubular electrode. In use, the tubular electrodes 232–244 are engaged fully within the slots 264. The channels 266 allow the gas to escape over the edges of the electrodes (which are in line with the base 268 of each slot 262) allowing a free passage for the gas over the majority of the surface area of the cap. The gas flows radially outwardly through the electrolyte 231. The constant flow of gas out of the cell will cause an electrolyte free region 233 to form at the top of the cell as shown in FIG. 3. This region 233 extends from end cap 260 to slightly below the level of the electrodes, so that electrolyte cannot pass across the electrodes. Thus, the leakage current which results from electrolyte bridging the electrodes, except immediately after start-up of the apparatus before region 233 has formed, does not occur thus improving efficiency.

Figure 6:
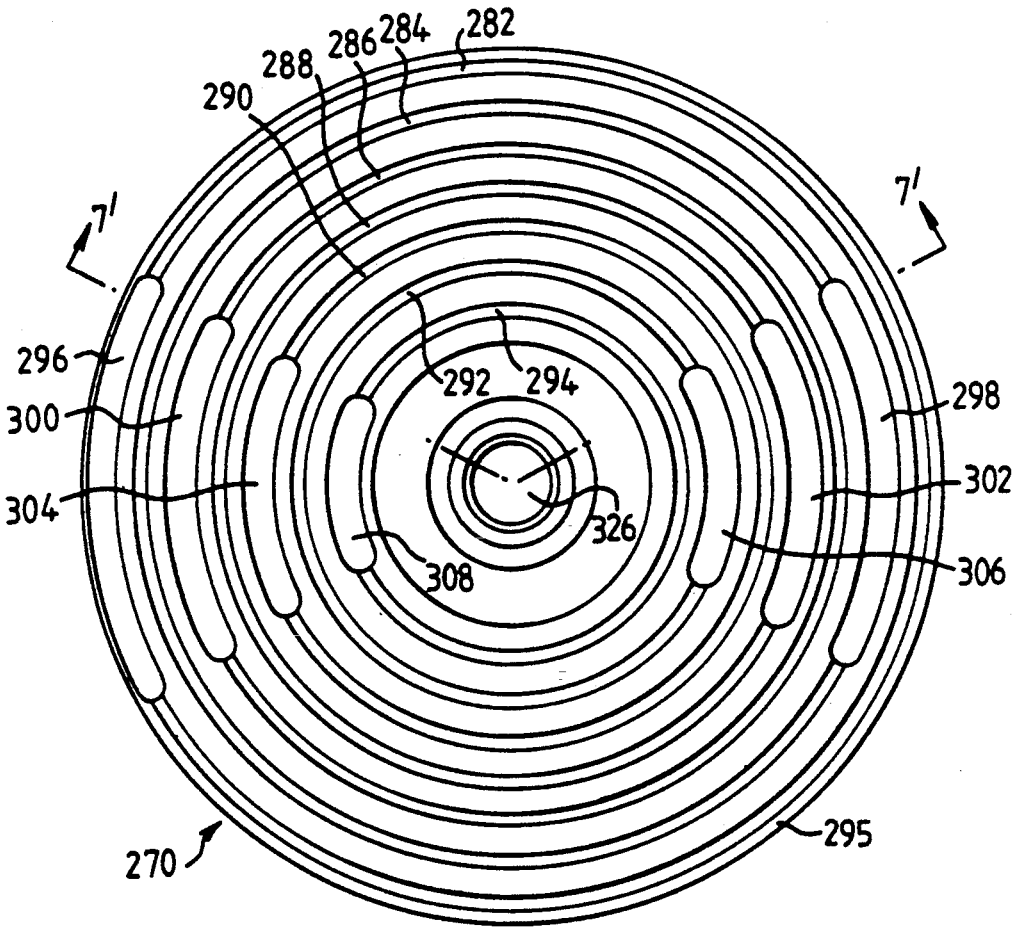
FIG. 6 is a plan view of a bottom end cap of the cell shown in FIG. 3.
Figure 7:
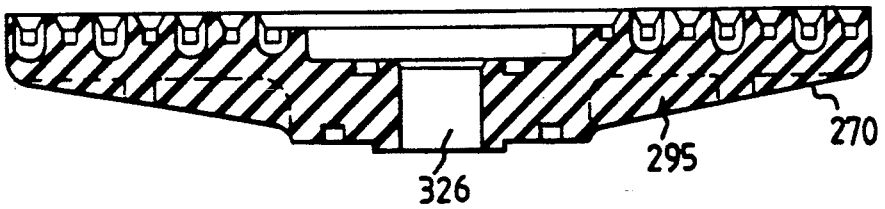
FIG. 7 is a view across section 7'—7' of FIG. 6.

The bottom end cap 270 is shown in FIGS. 6 and 7. Unlike the top end cap 260, it is necessary to provide an electrolyte path across each electrode, so that the level of electrolyte between the electrodes remains at a constant value. However, in order to minimise the leakage current which this causes, the resistance path is made as long and tortuous as possible. In this respect, each electrode 232–244 is located in a corresponding groove 282–294 in a base 295. Openings 296–308 are provided in each groove and these extend below the level of each groove as shown in FIG. 7. Each opening 296–308 provides a communication channel between the electrolyte filled regions on either either side of an electrode. In order to increase the resistance of the current leakage path, the openings, between adjacent pairs of regions, for example openings 296, 298, are offset relative to one another by 180°.

Figure 8:
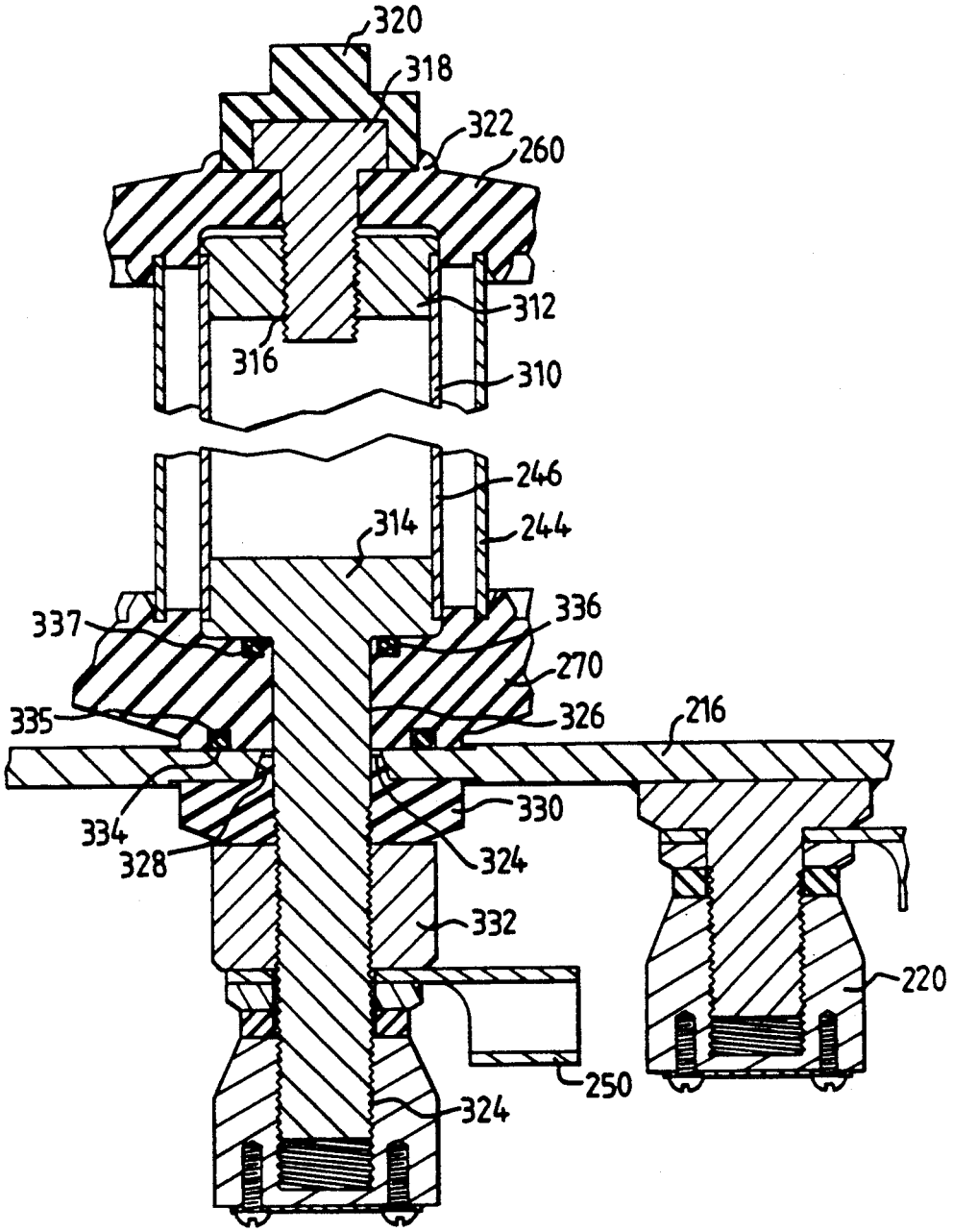
FIG. 8 is a sectional view of the mounting arrangement of the cell of FIG. 3.

The mounting arrangment of the electrodes and end caps within housing 216 is shown in FIG. 8. The anode 246 comprises a cylindrical tube 310 to which cylindrical connecting members 312, 314 are welded. Member 312 is provided with a central threaded opening 316 for receiving a bolt 318. Bolt 318 is provided with a plastic (preferably PTFE) insulating cap 320. The bolt 318 is fed through the central opening 265 in end cap 260 to hold the end cap in position relative to anode 246. Connecting member 314 is in form of an elongate bolt, having a threaded portion 324 which is arranged to passed through central opening 326 in end cap 270 and opening 328 in housing 216. As casing 216 forms the cathode of the electrolytic cell and is connected to the negative terminal of the DC power supply via connector 220, it is essential that connecting member 314, which is connected to positive terminal 250, does not make contact with casing 216, otherwise a short circuit would develop. In order to space member 314 from casing 216, a self locating spacer element 330 formed from insulating material (preferably PTFE) is provided which guides the anode 246 relative to casing 216 while leaving a gap 324 therebetween. The connecting member 314 is held relative to the casing 216 by bolt 332 which acts to clamp the anode 246, end cap 270 and spacer element 330 together. '0' rings 334, 336 are provided in respective annular channels 335, 337 in the end cap 270 to prevent leakage of electrolyte at the junction between the anode 246 and end cap 270 and the casing 216 and the end cap 270 respectively.

The remaining electrodes 232–244 are held in place between the end caps 260, 270 when the bolt 314 and nut 332 are engaged with the anode 246.

By this arrangement both the functions of sealing the casing and retaining the electrode assembly in the housing 216 are provided. The direct connection between the end cap 270 and, on one surface, the anode and, on the other surface, the casing provides a strong joint while at the same time providing the necessary sealing due to the '0' rings 334, 336.

In use, the cells are filled on demand with deionized water from the demister 400. All cells are filled simultaneously via the water inlet manifold (not shown) so that the levels remain the same. A single level sensor CLS, with a 5 mm hysteresis provided for sensing the water level.

Power is applied to electrical connections 220, 250 and the water (electrolyte) in the cell electrolyses and the resulting hydrogen/oxygen mixture is vented from the cells through outlet 214.

The hydrogen oxygen mixture is then processed by a demister 400.

Figure 9:
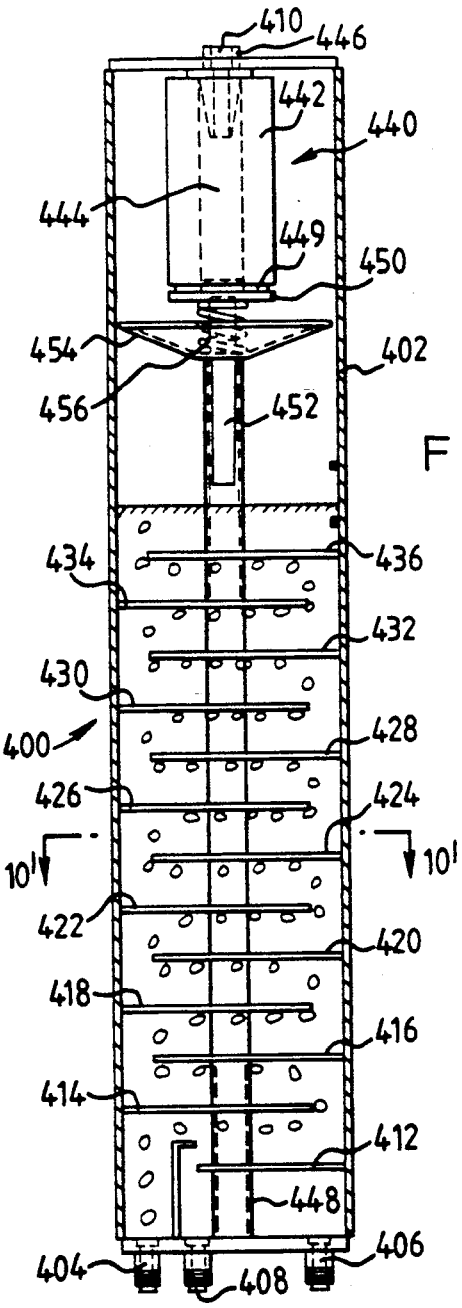
FIG. 9 is a sectional view of the demister of FIG. 1.
Figure 10:
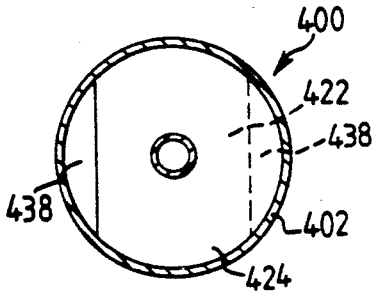
FIG. 10 is a view across section 10'—10' of FIG. 9.

The demister, 400 is shown in FIGS. 9 and 10 and comprises a hollow cylindrical housing 402 having: a gas inlet 404 which is connected to the gas outlet manifold 215 of the cells 200, a deionized water inlet 406 which is connected to pump assembly 450, an entrained electrolyte outlet 408 which is connected to the cell water inlet manifold (not shown) and a dry/clean gas mixture outlet 410. A plurality of circular plates 412–416 are welded, at spaced intervals, to a central tube 448. Each plate has a segment 438 removed therefrom, as is shown in FIG. 10 for plate 424 (and in phantom lines for plate 422) so that the plates 412–16 provide a meandering path for the gas mixture introduced at inlet 404. The demister is filled with deionized water up to a level above the uppermost plate 436 and between upper and lower level sensors DHLS and DLLS so that the gas mixture introduced through inlet 404 will bubble up through the deionized water along the meandering path as shown. The water is deionized so that it has a high receptiveness to dissolving any potassium hydroxide vapour entrained in the gas.

A coalescing filter assembly 440 is provided at the top of the casing 402 and comprises a hollow cylindrical filter element 442, the central bore 444 of which is connected to gas outlet 410 via hollow plug 446. The filter element 442 is supported between plug 446 and central tube 448 by means of a seal 449 and flange 450. Flange 450 is provided with a tubular extension 452 which is received in tube 448 which is provided with a baffle 454. The flange 450 is biased against filter element 442 by means of coil spring 456 which rests against baffle 454.

In use, the gas mixture is bubbled through the deionized water, which dissolves a large proportion of any entrained potassium hydroxide vapour. Any remaining moisture vapour is removed by coalescing filter 440 so that dry/clean gas mixture exits through opening 410. Water vapour which has coalesced on filter 442 falls into baffle 454.

The electrolytic cell unit 200 and demister 400 both use the same working liquid (deionized water) and the gas generating apparatus is provided with an on-demand pumping system 450 shown schematically in FIG. 1. The electrolytic cells, if precipitation of dissolved solids is to be avoided, need to use deionized water to add to the Potassium Hydroxide. Conveniently, the cells use the demister working liquid, which in use would be a weak solution of electrolyte due to the dissolved potassium hydroxide vapour.

Pumping system 450 comprises a pump 710 of duplex form having a first flow path 400 from a deionized water input line 700 to the demister 400, which is shown by slanted lines and designated 720, and a second path from the demister to the cells shown by cross-hatched lines and designated 730. Solenoid operated valves 730, 732, 734, 736 control the flow of liquid to and from pump 710. The pump and solenoids are controlled by means of an auto-fill control board 740 which receives input signals from an electrolytic cell sensor CLS, a demister high level sensor DHLS, a demister low level sensor DLLS, a water supply sensor WSS and a water quality sensor WQS.

The pump and solenoids are controlled to supply deionized water to the demister and electrolytic cells in accordance with the truth table shown in below:

AUTOFILLYSTEM TRUTH TABLE

| | INPUTS | | | OUTPUTS | | | | | |
|---|---|---|---|---|---|---|---|---|---|
| No.: | DEM. H. LS | DEM. L. LS | CELL LS | PUMP | SVA | SUB | SUC | SVD | COMMENTS |
| 1 | OFF | OFF | OFF | OFF | O | C | C | O | NO OPERATION UNTI (A) DEM LS = ON (B) CELL LS = ON (C) DEM DRAIN = ON |
| 2 | OFF | ON | OFF | ON | O | C | C | O | PUMP DEIONIZED WFER INTO DEMISTER |
| 3 | OFF | OFF | OFF | ON | O | C | C | O | |
| 4 | ON | OFF | OFF | OFF | O | C | C | O | |
| 5 | X | X | ON | ON | C | O | O | C | FILL CELL WITH DEONISED WATER/KOH UNTIL CELL LS TURS "OFF" |

X = DON'T CARE
C = CLOSED
O = OPEN

Figure 11:
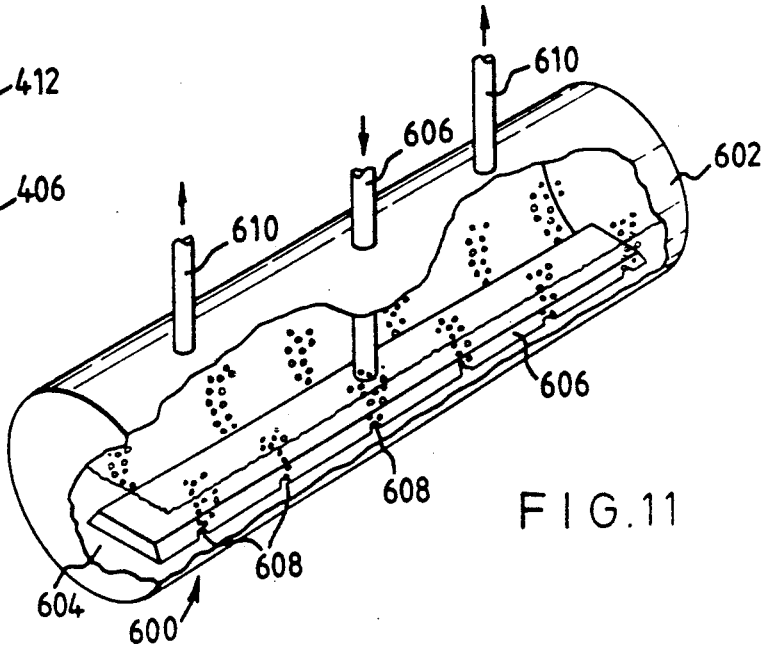
FIG. 11 is a perspective part-sectional view of the modifier of FIG. 1.

The cleaned/dried gas mixture is then fed, via a gas pressure/flow rate regulator of standard construction to the modifier 600 which is shown in detail in FIG. 11.

The modifier acts to change the combustion characteristics of the gas mixture and includes a pressure vessel 602 in which a volatile organic compound in liquid form (e.g. hydrocarbon, alcohol or ketone) is disposed. An inlet pipe 606 from demister 400 is connected to a gas diffuser 606 disposed within the pressure vessel 602 below the surface of liquid 604. The diffuser is in the form of an inverted tray having notches 608 provided at spaced intervals around the periphery. The diffuser 606 acts to "spread" the gas mixture so that the gas mixture bubbles through the liquid 604 over a large area. The act of bubbling the gas through the liquid causes molecules of the liquid to be entrained in the gas so that the gas mixture exiting the modifier through outlets 610 includes, in addition to the hydrogen and oxygen mixture, a percentage of the hydrocarbon. This percentage can be adjusted in using modifier bypass valve 650.

The way in which the modifier works can best be appreciated by consideration of the following examples:

1) Assuming the hydrocarbon contained within the modifier is Hexane is ($C_6H_{14}$), addition of Hexane molecules to the hydrogen/oxygen mixture will modify the combustion characteristics so that the mixture will imitate a mixture of propane and oxygen as shown below:

$$\text{Average}\left\{\begin{matrix} C_6H_{14}\ O_2 \\ 2H_2\ C_6H_{14} \end{matrix}\right\} \longrightarrow C_3H_8 + O_2$$

2) Mixing methanol ($Ch_3OH$), hydrogen and oxygen will imitate a mixture of acetylene and oxygen as shown below.

$$\text{Average}\left\{\begin{matrix} CH_3OH \\ \qquad\quad O_2 \\ 2H_2 \end{matrix}\right\} \longrightarrow C_2H_2 + O_2$$

The addition of hydrocarbons in this manner principally affects the temperature and heat content of the gas flame. Thus, by using different modifiers, the flame characteristics can be adjusted and controlled.

The modifier pressure vessel 602 provides the added function of a gas mixture reservoir.

The modified gas mixture is fed via the flash arrester 600 to a welding torch (not shown).

Depending upon the working liquid of the modifier, the extra preheat oxygen which will be required for a neutral flame may be obtained solely from the atmosphere if the modifier liquid is of low entrainment (e.g. heptane, toluene) or possesses some bonded oxygen (e.g. methanol, ethanol, ketone). For modifier liquids of high entrainment (e.g. hexane) some additional preheat oxygen is required. This is provided by an oxygen cylinder (not shown) in the same manner as traditional fuel gases.

Control of the flow of gas mixture is provided by control board 800 which controls the flow of gas in accordance with a desired value as shown in the flowchart of FIG. 12.

The flowrate is calculated indirectly by measuring the actual current IAC supplied to the cells measuring the rate of change of temperature and pressure in the electrolylic cells and in the modifier in accordance with the following equation:

$$\text{Flowrate} = K1 \cdot IC - \frac{K4\,\Delta PM}{\Delta TM \cdot t_S} - \frac{K5\,\Delta PR}{\Delta TR\, t_S} \qquad 1$$

This equation which is based on the ideal gas equation and Faraday's law and is derived as follows:

The following symbols are used.

GR=Generation rate of hydrogen and oxygen gas within the electrochemical cells.

FR=Flowrate of hydrogen, oxygen and hydrocarbon vapour from the output nipple of the machine.

Pm=Pressure of the gas in the gas generating vessels.

Tm=Temperture of the gas in the gas generating vessels.

Vm=Volume of the gas generating vessels. (constant)

Pr=Pressure of the gas in the gas modifying (regulated) vessel.

Tr=Temperature of the gas in the gas modifying (regulated) vessel.

Vr=Volume of the gas in the gas modifying (regulated) vessel. (constant)

Ic=D.C. convert which passes through the cells.

nm=Number of moles of gas generating vessels.

nr=number of moles of gas in gas modifying vessels.

R=Universal gas constant.

$t_S$=Sampling period.

As the gas generating cells 200, demister 400, regulator 500 and modifier 600 are a closed system, flowrate FR can be expressed as:

$$FR = \begin{matrix}\text{gas}\\ \text{generation}\\ \text{rate}\end{matrix} - \begin{matrix}\text{rate of increased}\\ \text{in storage in gas}\\ \text{generating vessels}\end{matrix} - \begin{matrix}\text{rate of increase}\\ \text{in storage in}\\ \text{modifying vessel}\end{matrix} \qquad 2$$

Generation Rate

The generation rate of Hydrogen and Oxygen can be calculated in reference to Faraday Law so that:

$$\text{Generation Rate} = K1.IC \qquad 3$$

$K_1$ is a constant which depends upon the number of individual cells connected and the chemical reactions. This can be determined from basic electrochemical theory or experimentally using a standard current probe and flowmeter.

The rate of increase in gas storage can be determined using the universal gas equation:

$$PV = nRT$$

$$\text{Rate of increase in storage} = \frac{\text{Vol Gas STP}}{\text{Time}}$$

$$\text{Vol Gas STP} = n \times K \text{ liters}$$

where K=constant derived from Universal Gas Equation where n=PV/RT

For a Fixed Volume (V=constant)

$$\text{Vol Gas}_{\text{stp}} = \frac{K \times PV}{T} \qquad 4$$

$$\text{Let } K4 = \frac{KV}{R}$$

$$\text{Vol Gas}_{\text{stp}} = K4 \times \frac{P}{T}$$

$$\text{Rate of increase in storage} = \frac{K4\,\Delta P}{\Delta T \cdot t_S}$$

Combining equations 2, 3 and 4 gives the equation for flowrate (equation 1).

The rate of change of temperatures and pressures are obtained by samplying and storing (at sample period $t_S$) values for temperature and pressure as sensed by sensors MTT, MTP, RTT and RPT.

With reference to the flowchart of FIG. 12, when power is actuated via a user operated switch 940 a start routine is entered at step 12.1. The main power relay is then disabled and the cell current set to 0 at step 12.2 after which a cell test routine is performed at step 12.3.

The alarm sensors (discussed below) are then all monitored and gas production is enabled if no alarm sensor is set. The outputs from the pressure temperature and cell current sensors IAC, MTT, MTP, RTT and RTP are all measured and the flowrate calculation is then made at step 12.6. The flowrate and cell pressures are then displayed respectively on displays 920, 930 at step 12.7. If no gas generation is needed to meet the required demand and maintain systems pressure, or if system pressure is above a predetermined maximum, the current is reduced to zero and the routine returns to step 12.4. If, however, gas generation is required, the required cell current is calculated in accordance with the equation in box 12.9 to maintain gas flowrate at the required (demanded) level and to have the gas pressure in the cells at a sufficiently high level to meet sudden increases in demand without affecting regulated pressure and rate of modifer entrainment. $P_I$ is chosen ideal system pressure e.g. of 40 psi. K2 is an experimentally derived constant. The current is limited between minimum and maximum values. The new current signal is then sent to firing board 802 which adjusts the DC current supplied to the cells 200. The routine then loops to step 12.4 and continues as described above.

Figure 13:
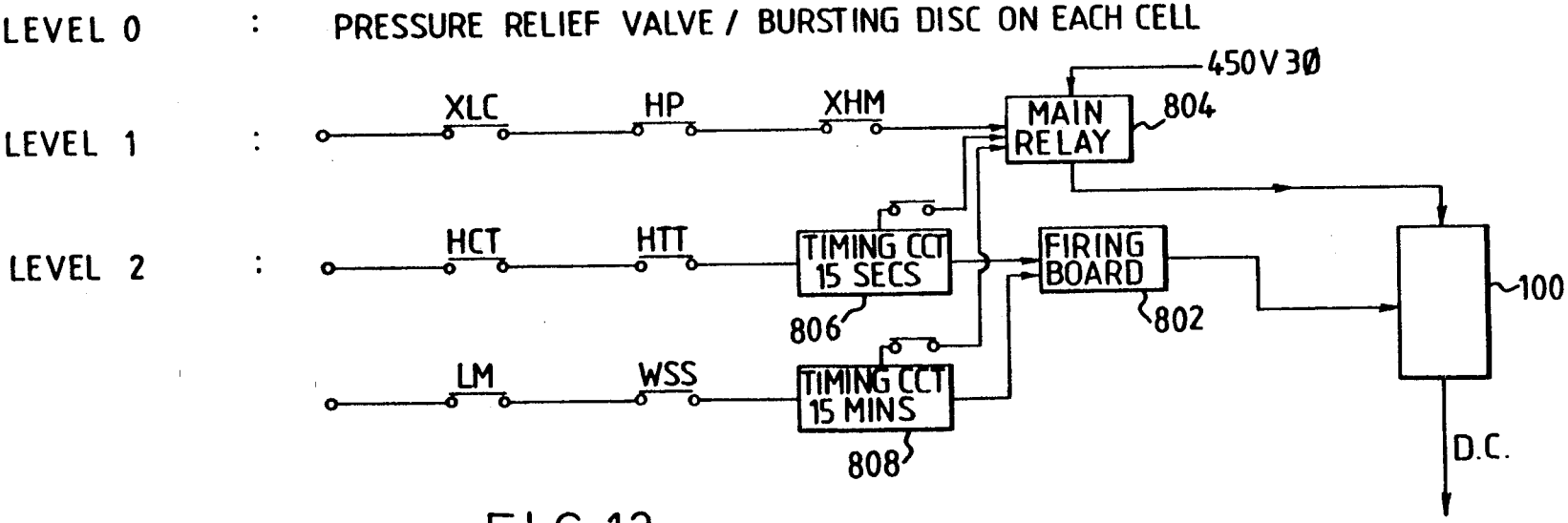
FIG. 13 is a schematic diagram of the fail-safe mechanisms of the apparatus of FIG. 1.

In step 12.4, the control board monitors the alarm sensors. These are configured as part of a three level safety system as illustrated in FIG. 13.

Each level comprises sensors/actuation means which are wholly independent one from the other.

Specifically, level 0 comprises a pressure relief valve/bursting disk provided on each cell, for releasing the pressure in the cell if it gets to an unacceptably high level.

Level 1 comprises an extra low cell water level XLC sensor, a high cell pressure sensor HP (lower than the relief valve pressure) and an extra high modifier working liquid level sensor XHM. If either of the sensor reach the critical level they cause a respective switch to open thus breaking a circuit to main power relay 804, which trips out.

Level 2 comprises two sets of sensors which have associated time lags. Sensors HCT and HTT monitor high cell temperature and high transformer temperatures respectively and, if either switch reaches its critical level it causes a corresponding switch to open which actuates a 15 seconds timing circuit. On expiry of the 15 second period, an output signal disables firing board 802 disabling. A corresponding back-up signal is also sent to the main relay 804 disabling this as well.

The low modifier working liquid level sensor LM and the low water supply level sensor WSS are connected to a 15 minute timing circuit operating in the same way as the 15 second timing circuit.

Tripping of any of the level 1 or level 2 sensors causes control board 800 to actuate alarm 910 and indicate which sensor has shown a problem.

A further, independent water sensor WQS, (water quality sensor) is provided, which ensures that the electrolyte does not become contaminated, prolonging the life of the machine and ensuring sensors are not affected by ferric oxide (rust caused by chloride ions etc.). This provides a warning signal to control boards 740, 800 as shown.

While the invention has been described to a for use as part of a hydrogen/oxygen gas producing apparatus for welding, this is not to be construed as limitative and the apparatus may be used for generation of other gase mixtures and for other applications, for example for heating or gas cutting, or for powering an internal combustion engine.

We claim:

1. An end cap for an electrolytic gas generation cell including a plurality of nested electrode tubes, the end cap having means for locating the tubes in spaced relation and a plurality of channels interconnecting the regions between the locating means.

2. An end cap as claimed in claim 1 further comprising a base member, a plurality of slots and channels being formed in the base member.

3. An end cap as claimed in claim 2 wherein the channels are formed deeper than the slots and concentrically therewith.

4. An end cap for an electrolytic gas generation cell including a plurality of nested electrode tubes, the end cap having means for locating the tubes in spaced relation and a plurality of openings offset relative to one another interconnecting the regions between the locating means.

5. An end cap as claimed in claim 4 where the openings between adjacent pairs of regions are opposed to one another.

6. An end cap for an electrolytic gas generation cell including a plurality of nested electrode tubes, the end cap comprising a base member; means formed in the base member for locating the tubes in spaced relation, said locating means comprising a plurality of lands, each land provided with a plurality of slots; and a plurality of channels formed in the base member between the lands; wherein the bases of the slots are aligned with the tops of the channels.

* * * * *